US008733852B2

(12) United States Patent
Gold et al.

(10) Patent No.: US 8,733,852 B2
(45) Date of Patent: May 27, 2014

(54) TOILET BRUSH CADDY

(75) Inventors: Jason Brian Gold, Scottsdale, AZ (US); Matthew David Marhefka, Doylestown, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 884 days.

(21) Appl. No.: 12/505,084

(22) Filed: Jul. 17, 2009

(65) Prior Publication Data

US 2010/0140117 A1 Jun. 10, 2010

Related U.S. Application Data

(60) Provisional application No. 61/120,011, filed on Dec. 4, 2008.

(51) Int. Cl.
*A46B 17/00* (2006.01)

(52) U.S. Cl.
USPC ..... 312/206; 206/15.3; 206/361; 312/207

(58) Field of Classification Search
USPC ..... 206/361, 15.3; 312/206
See application file for complete search history.

(56) References Cited

U.S. PATENT DOCUMENTS

| | | | | |
|---|---|---|---|---|
| 2,464,085 | A | 3/1949 | Hess | |
| 4,033,650 | A * | 7/1977 | Alissandratos | 312/206 |
| D315,989 | S | 4/1991 | Levien | |
| 5,772,015 | A | 6/1998 | Musiel et al. | |
| 6,647,567 | B1 * | 11/2003 | Baldwin et al. | 4/661 |
| 6,726,010 | B2 | 4/2004 | Kaminstein | |
| D500,423 | S | 1/2005 | Rich | |
| D500,619 | S | 1/2005 | Rich | |
| 6,902,056 | B2 * | 6/2005 | Dotterman et al. | 206/361 |
| D508,608 | S | 8/2005 | Huff | |
| D515,858 | S * | 2/2006 | Hay | D6/524 |
| 7,044,299 | B2 | 5/2006 | Nagoya | |
| 2003/0209458 | A1 * | 11/2003 | Kaminstein | 206/361 |
| 2006/0138002 | A1 | 6/2006 | Gillissie et al. | |
| 2008/0066247 | A1 | 3/2008 | Yang et al. | |

OTHER PUBLICATIONS

Toilet Bowl Brush and Caddy manufactured by Quickie Manufacturing having Item No. 305CRMB, 3 pgs.
Toilet Bowl Brush and Caddy manufactured by Quickie Manufacturing having Item No. 312CRMB, 3 pgs.
Toilet Bowl Brush and Holder manufactured by Clorox, 5 pgs.

* cited by examiner

*Primary Examiner* — Anthony Stashick
*Assistant Examiner* — Raven Collins
(74) *Attorney, Agent, or Firm* — Gregory J. Winsky; Jason F. Cotter; Archer & Greiner, P.C.

(57) ABSTRACT

A toilet brush caddy is provided, includes a unitary one-piece housing, and is capable of supporting a toilet brush. The housing includes a brush receptacle and the toilet brush includes a handle and a cleaning head having a plurality of bristles. The caddy is capable of supporting the toilet brush such that the toilet brush is supported at an angle relative to the vertical, only contacts a front side of the brush receptacle, and the bristles do not contact any other portion of the brush receptacle when the brush is supported by the caddy.

23 Claims, 16 Drawing Sheets

TOILET BRUSH CADDY

RELATED APPLICATIONS

The present application claims priority to U.S. Provisional Patent Application No. 61/120,011, filed Dec. 4, 2008, the entire contents of which is incorporated herein by reference.

FIELD OF THE INVENTION

The present invention generally relates to toilet brush caddies and, more particularly, to toilet brush caddies including a unitary one-piece housing.

SUMMARY

In one example, a toilet brush caddy is provided.

In another example, a toilet brush caddy is provided and includes a unitary one-piece housing.

In yet another example, a toilet brush caddy is provided and is capable of supporting a toilet brush such that a cleaning head of the toilet brush does not contact a bottom of a brush receptacle of the caddy. The toilet brush may also be supported by the caddy such that the cleaning head only engages a single wall of the brush receptacle.

In still another example, a toilet brush caddy is provided and includes a housing and a rim. The housing is supportable on top of the rim and includes a brush receptacle and a brush support. The brush receptacle has a central longitudinal axis extending at an angle relative to a vertical axis of the housing and the brush support includes a longitudinal axis extending at an angle relative to the vertical axis. The central longitudinal axis of the brush receptacle can extend to a first side of the vertical axis and the longitudinal axis of the brush support can extend to a second side of the vertical axis opposite the first side. The longitudinal axis of the brush receptacle may extend at an acute angle relative to the vertical axis.

In a further example, a toilet brush caddy for supporting a toilet brush is provided and includes a one-piece unitary housing defining a brush receptacle adapted for receiving a cleaning head of the toilet brush, the brush receptacle having a longitudinal axis extending at an angle relative to a vertical axis of the toilet brush caddy.

In yet a further example, a toilet brush caddy for supporting a toilet brush is provided and includes a one-piece unitary housing defining a brush receptacle adapted for receiving a cleaning head of the toilet brush, the housing including a brush support adapted to be engaged by and support the toilet brush such that the cleaning head is positionable in the brush receptacle, the brush support including a longitudinal axis extending at an angle relative to a vertical axis of the toilet brush caddy.

In still a further example, a toilet brush caddy for supporting a toilet brush is provided and includes a one-piece unitary housing including an exterior wall, an inner wall spaced inward from the exterior wall and defining a brush receptacle adapted for receiving a cleaning head of the toilet brush, the brush receptacle having a longitudinal axis extending at an angle relative to a vertical axis of the toilet brush caddy, and a brush support adapted to be engaged by and support the toilet brush such that the cleaning head is positionable in the brush receptacle, the brush support having a longitudinal axis extending at an angle relative to the vertical axis of the toilet brush caddy, wherein the inner wall includes at least two sides and is adapted to extend around at least two sides of the cleaning head with the cleaning head positioned in the brush receptacle, and the cleaning head contacts no more than one of the at least two sides of the inner wall with the cleaning head positioned in the brush receptacle.

Figure 1:
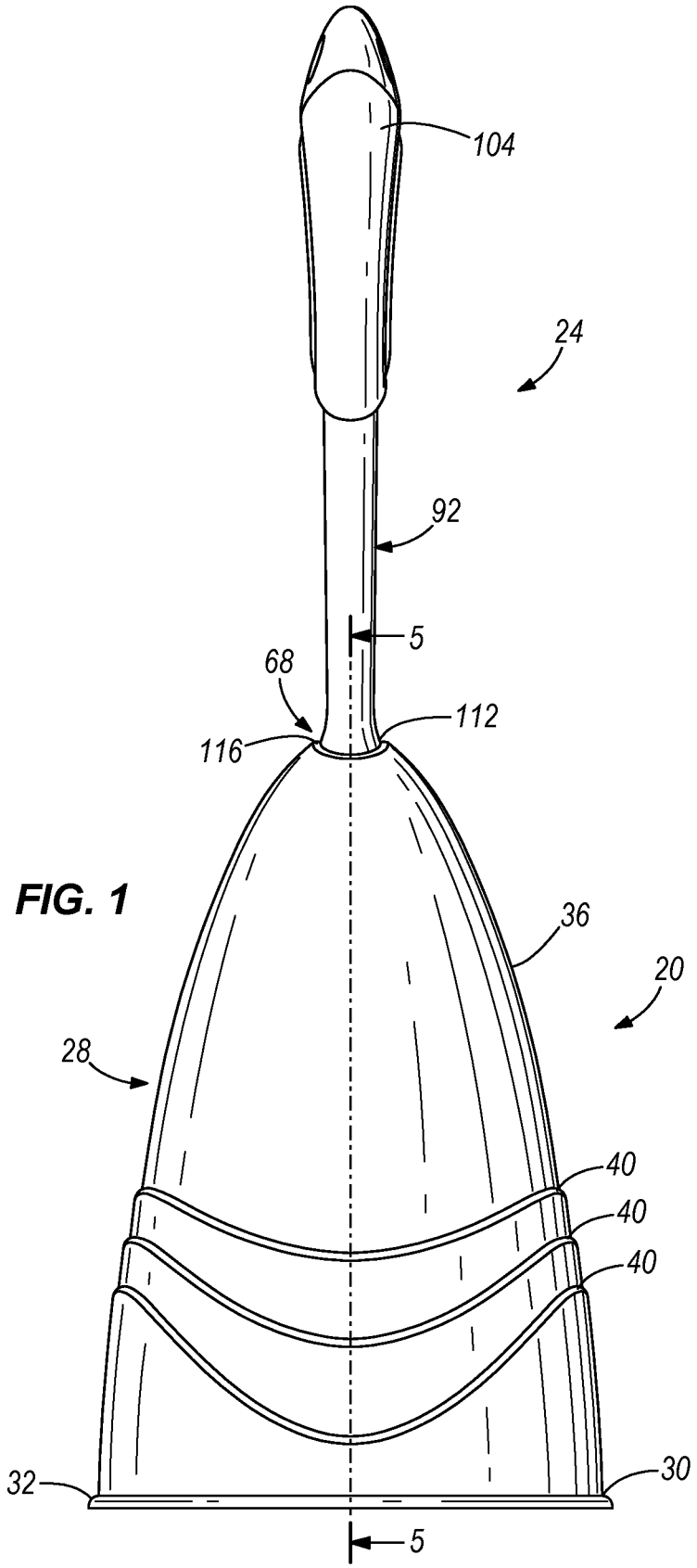
FIG. 1 is a front view of an exemplary toilet brush caddy supporting an exemplary toilet brush.
Figure 2:
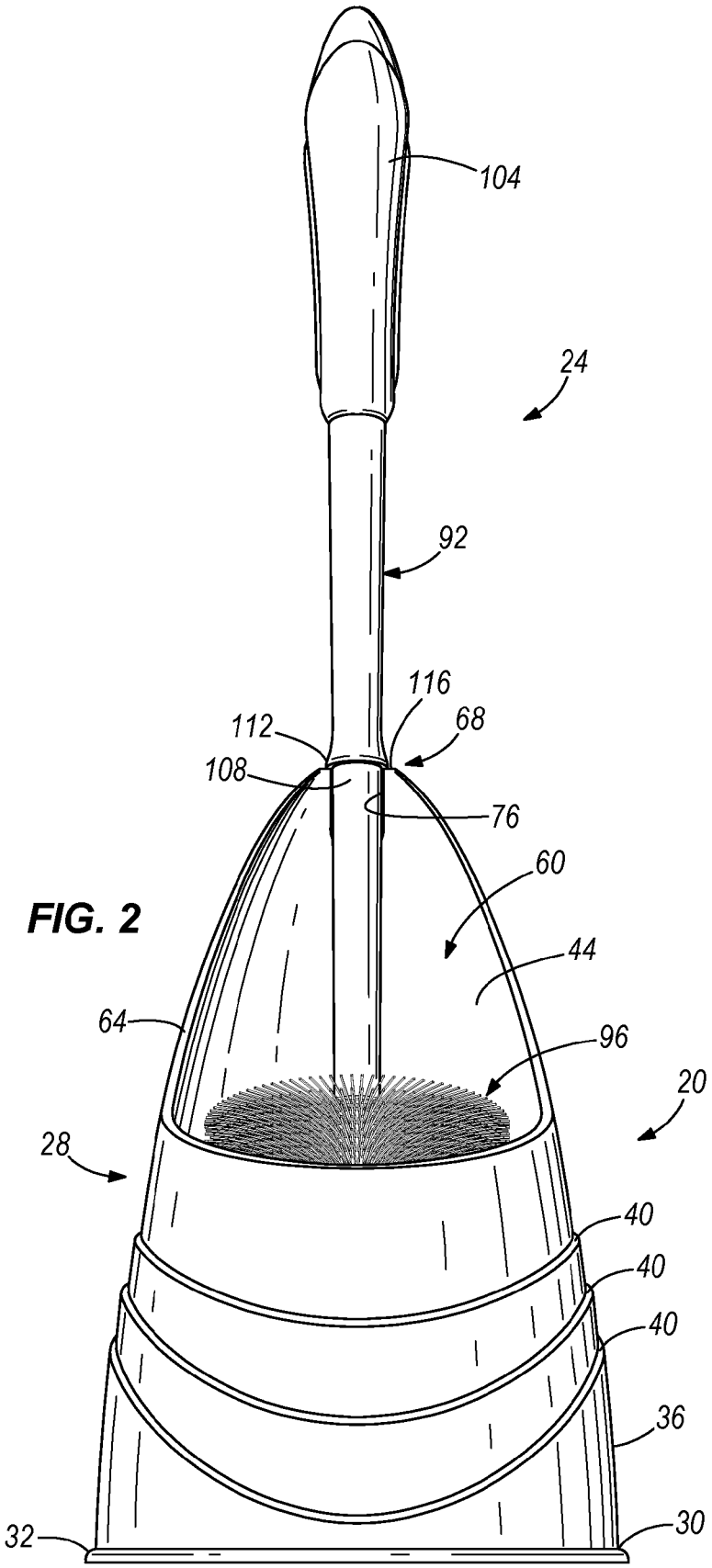
FIG. 2 is a rear view of the toilet brush caddy and toilet brush shown in FIG. 1.
Figure 3:
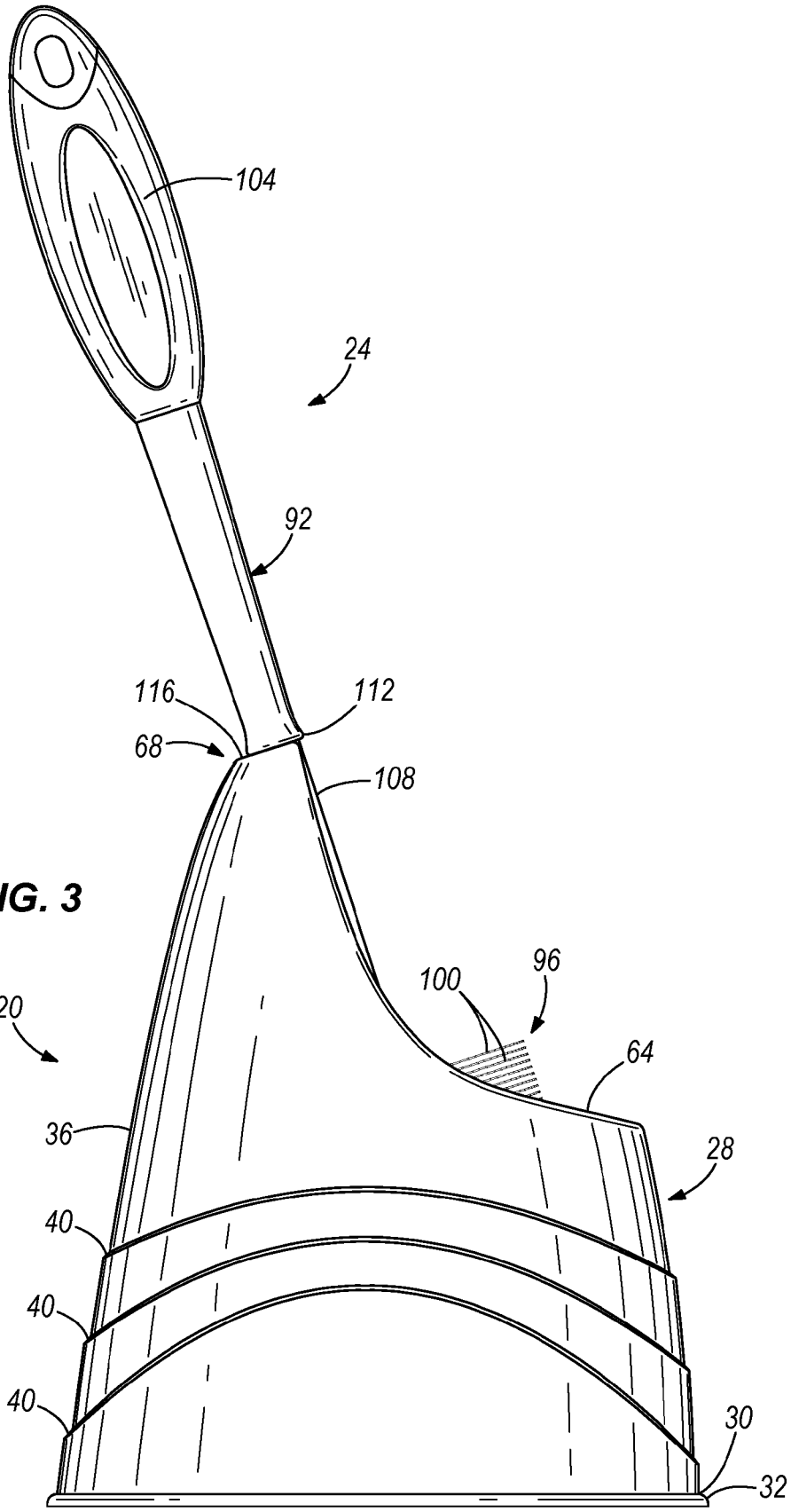
FIG. 3 is a right side view of the toilet brush caddy and toilet brush shown in FIG. 1.
Figure 4:
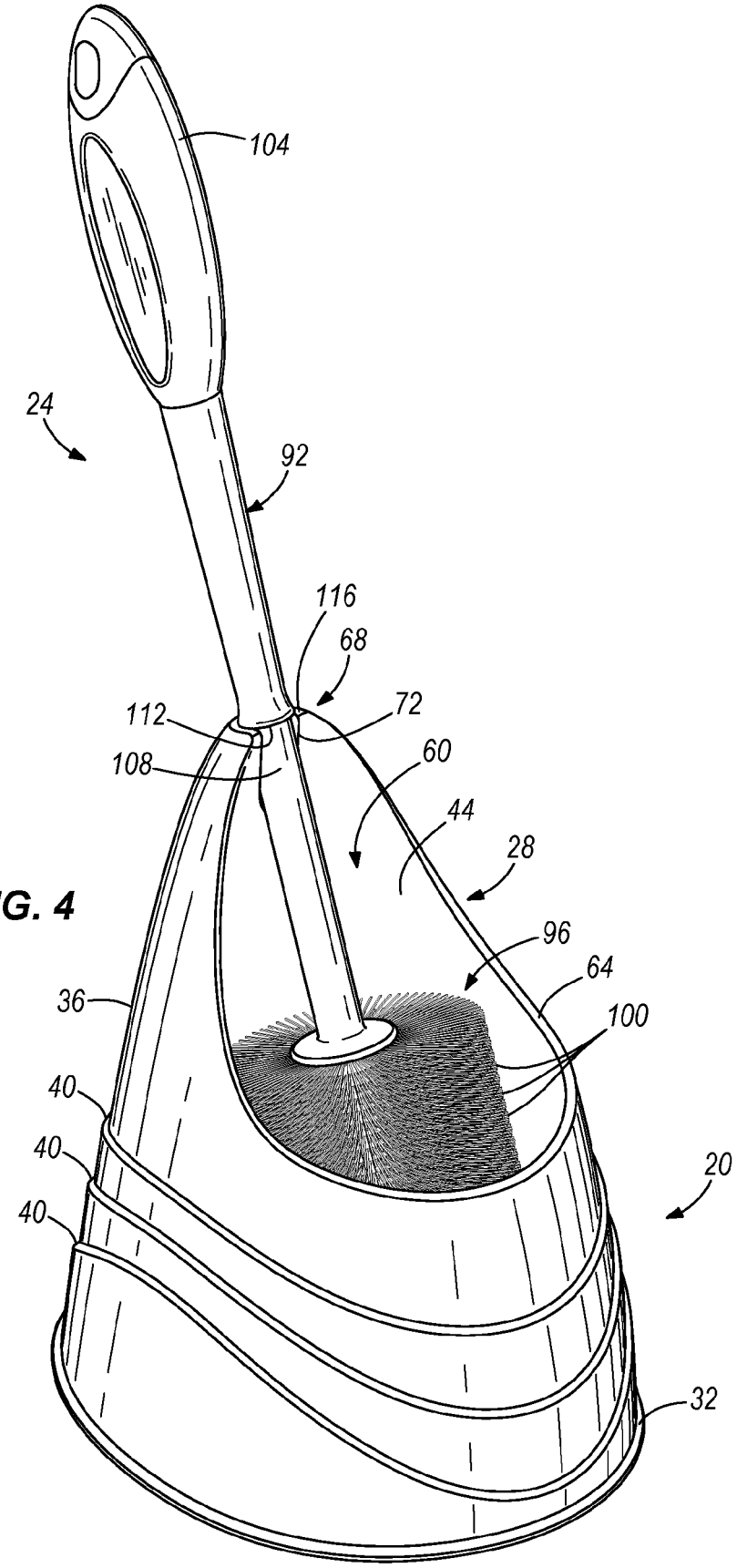
FIG. 4 is a top rear perspective view of the toilet brush caddy and toilet brush shown in FIG. 1.

Before any independent features and embodiments of the invention are explained in detail, it is to be understood that the invention is not limited in its application to the details of the construction and the arrangement of the components set forth in the following description or illustrated in the drawings. The invention is capable of other embodiments and of being practiced or of being carried out in various ways. Also, it is understood that the phraseology and terminology used herein is for the purpose of description and should not be regarded as limiting.

DETAILED DESCRIPTION

With reference to FIGS. 1-4, an exemplary toilet brush caddy 20 is illustrated and is operable to support a toilet brush 24. The illustrated toilet brush 24 is an exemplary toilet brush and the caddy 20 is capable of supporting a wide variety of toilet brushes. The caddy 20 includes a unitary one-piece housing 28 and a rim 32. The rim 32 may be secured to a bottom edge 30 of the housing 28 and is the portion of the caddy 20 contacting a floor surface when the caddy 20 is placed on the floor surface. In some examples, the rim 32 may be interference fit or friction fit to the bottom edge 30 of the housing 28. Alternatively, the rim 32 may be secured to the bottom edge 30 of the housing in a variety of other manners including, for example, adhering, bonding, coupling, fastening, etc. In some examples, the rim 32 may be made of a non-slip and/or high friction material such as, for example, rubber, and may inhibit slipping of the caddy 20 along the floor surface. In the illustrated example, the bottom edge 30 of the housing 28 has a generally oval or egg shaped periphery and the flexible rim 32 conforms to that shape when secured to the bottom edge 30. In some exemplary embodiments, the caddy 20 may not include a rim 32 and, in such embodiments, the bottom edge 30 of the housing 28 contacts a floor surface when the caddy 20 is placed on the floor surface.

Figure 5:
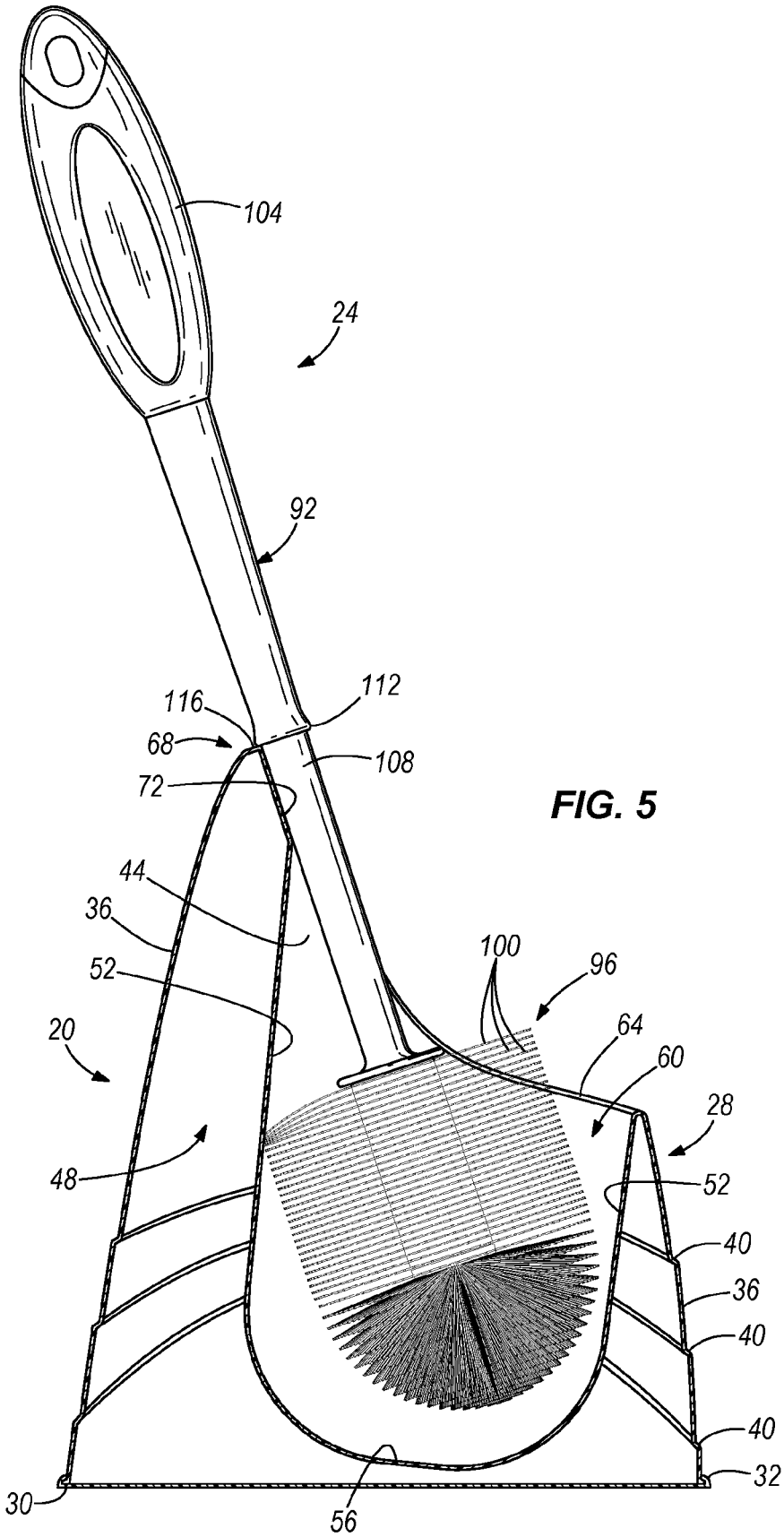
FIG. 5 is a cross-sectional view of the toilet brush caddy taken along line 5-5 in FIG. 1, the toilet brush is supported by the toilet brush caddy and is not shown in a sectioned manner.
Figure 7:
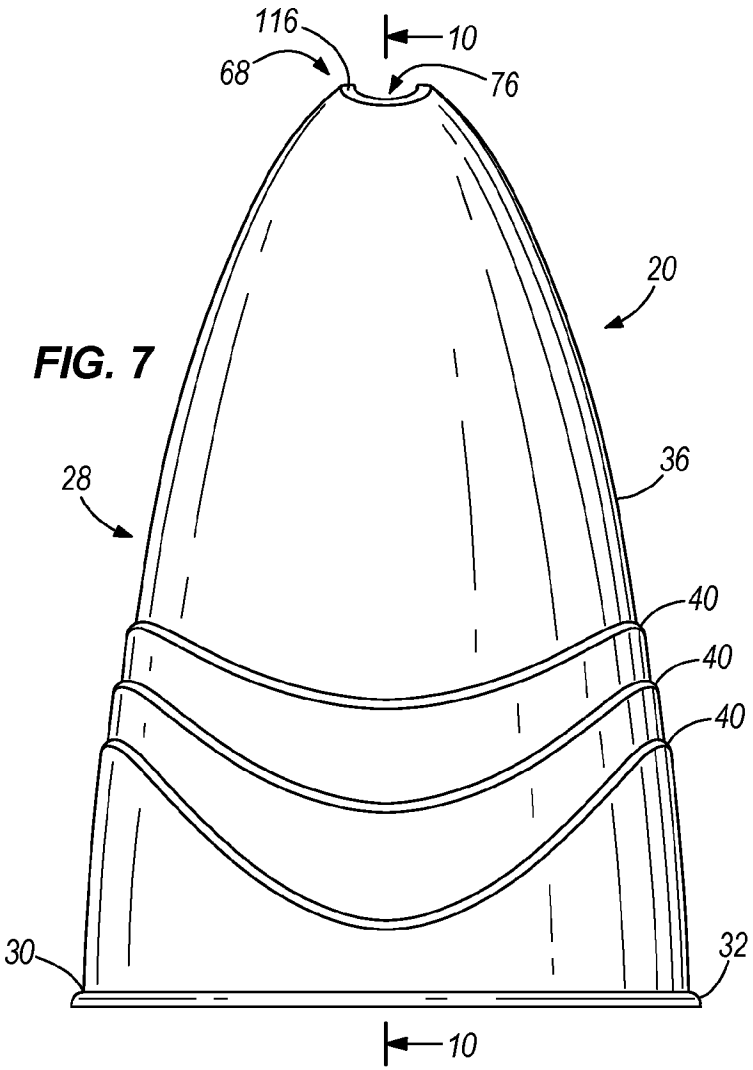
FIG. 7 is a front view of the toilet brush caddy shown in FIG. 6.
Figure 6:
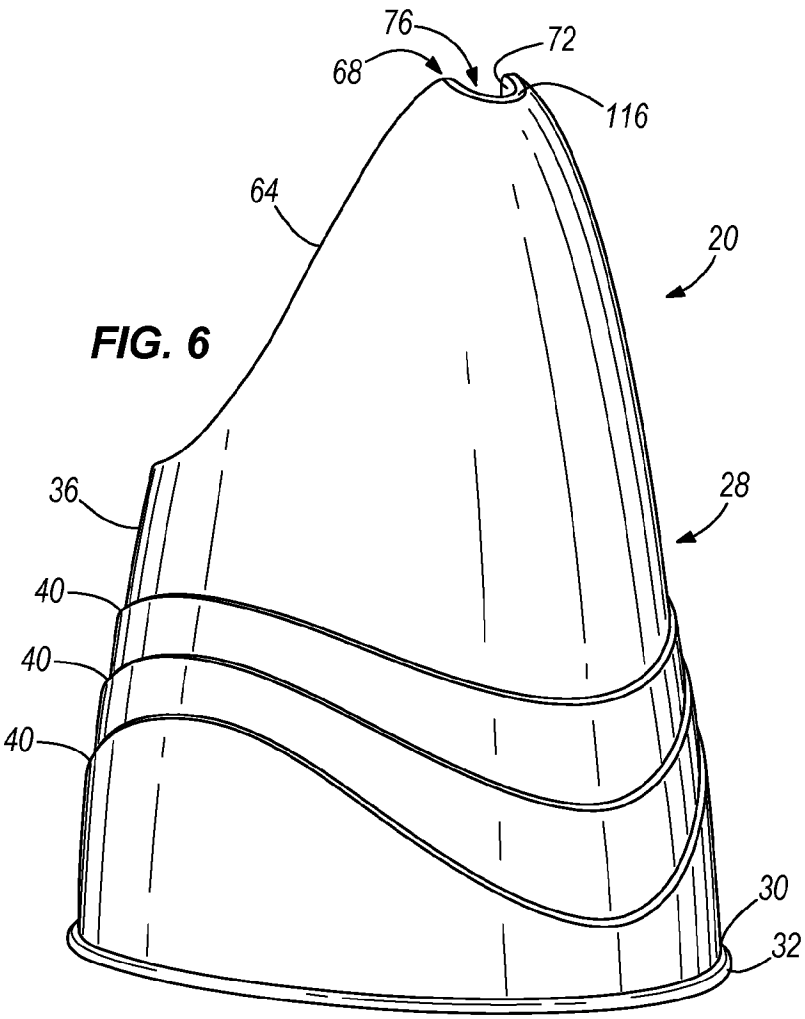
FIG. 6 is a top front perspective view of the toilet brush caddy shown in FIG. 1.
Figure 9:
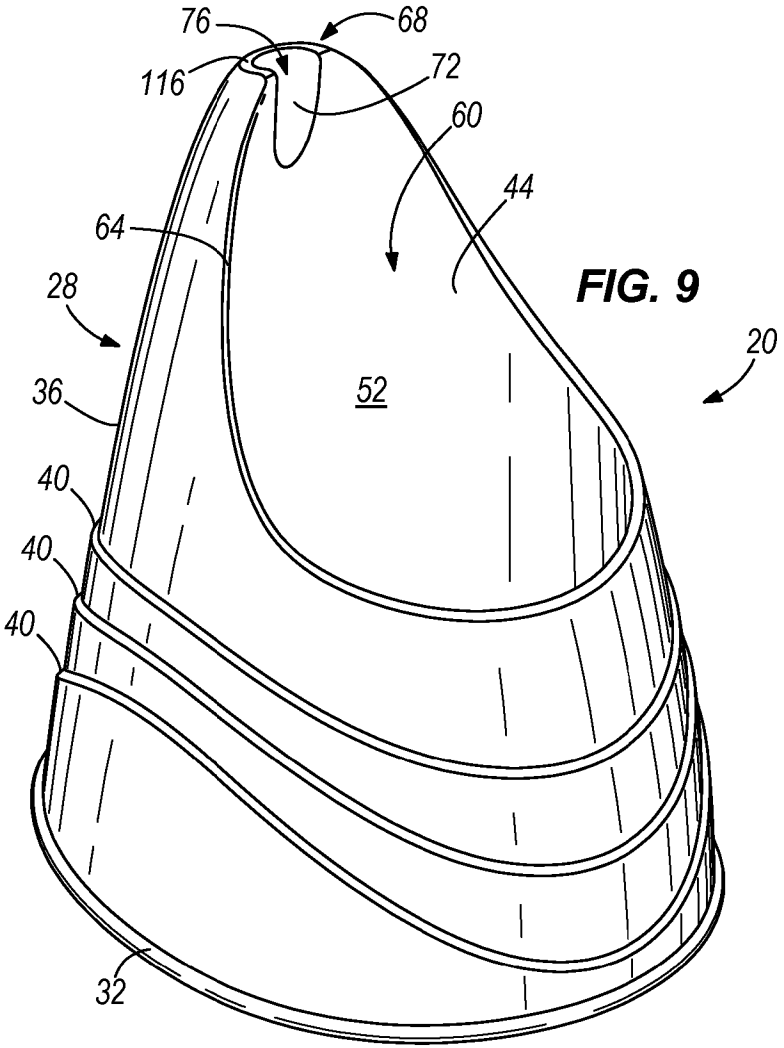
FIG. 9 is a top rear perspective view of the toilet brush caddy shown in FIG. 6.
Figure 8:
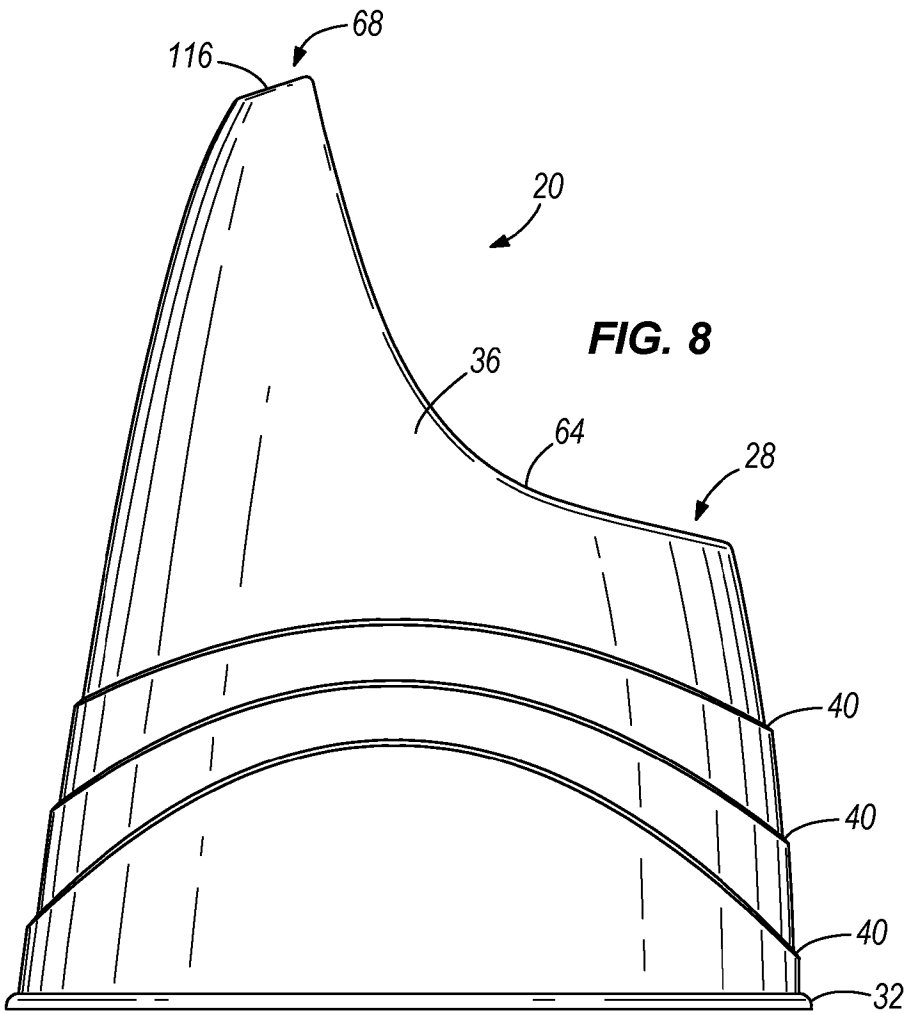
FIG. 8 is a right side view of the toilet brush caddy shown in FIG. 6.

With continued reference to FIGS. 1-4 and additional reference to FIG. 5, the housing 28 includes an exterior wall 36 having a plurality of steps 40 extending around the exterior wall 36. In the illustrated example, the exterior wall 36 includes three steps 40. Alternatively, the exterior wall 36 may include any number of steps 40 or may include other aesthetic features and be within the intended scope of the present invention. The housing 28 also includes an inner wall 44 defining a brush receptacle 60. The inner wall 44 is spaced apart from the exterior wall 36 providing a void 48 within the housing 28 and with the other features described herein allows the housing 28 to be easily manufactured, such as by injection molding. This construction of the housing 28 provides the caddy 20 with a relatively light weight. The inner wall 44 comprises a side wall 52 and a bottom wall 56, which together define the brush receptacle 60, which is enclosed on sides and a bottom end and open on a top end 64 only. The open top end 64 of the brush receptacle 60 facilitates insertion of the toilet brush 24 into the brush receptacle 60.

Referring now to FIGS. 5-9, the housing 28 further includes a brush support 68 for supporting the toilet brush 24. The brush support 68 includes a support wall 72 defining a support channel 76, which has an open top end and an open bottom end in communication with the brush receptacle 60. In the illustrated example, the support wall 72 is semi-circular in shape to accommodate toilet brushes 24 having a complimentarily shaped circular handle. Alternatively, the support wall 72 may have other shapes, such as, for example, semi-oval, semi-polygonal, etc., to accommodate toilet brushes 24 having handle shapes other than circular. Also, in the illustrated example, the support channel 76 has a diameter of about 0.5 inches and a depth of about 0.45 inches (see FIG. 11). Alternatively, the support channel 76 may have other sized diameters or depths to accommodate exemplary toilet brush handles having different sized handles and may have other sizes and shapes to accommodate exemplary toilet brush handles having different sized and shaped handles.

Figure 11:
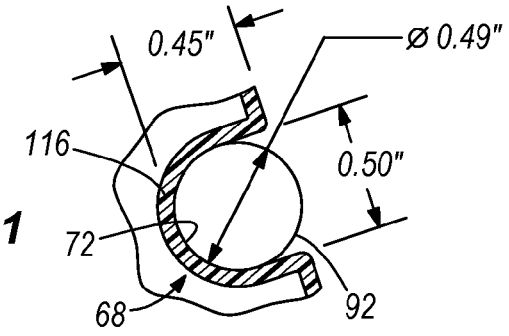
FIG. 11 is a partial end view of the brush support of the toilet brush caddy shown in FIG. 10.
Figure 10:
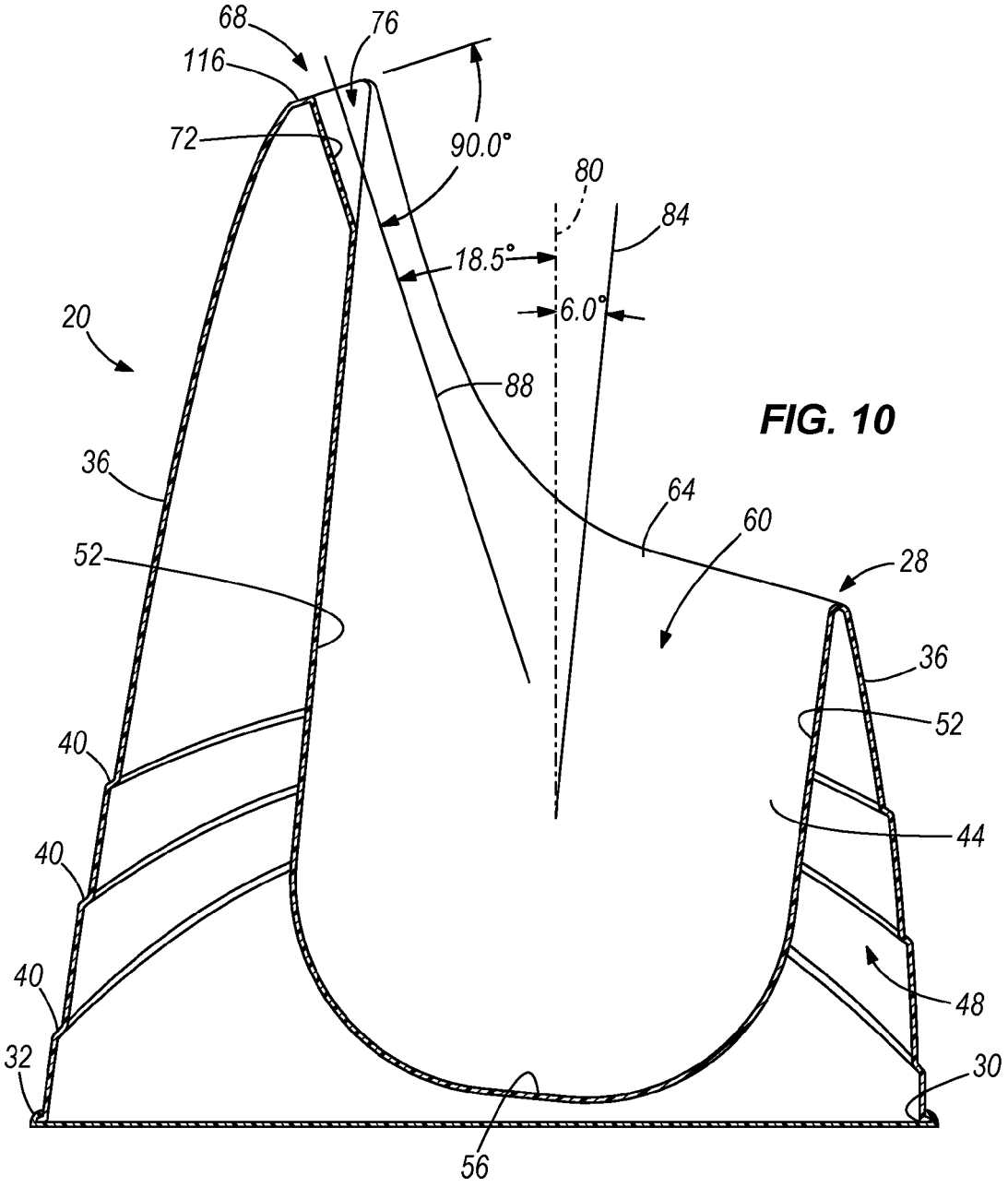
FIG. 10 is a cross-sectional view of the toilet brush caddy shown in FIG. 6 taken along line 10-10 in FIG. 7.
Figure 12:
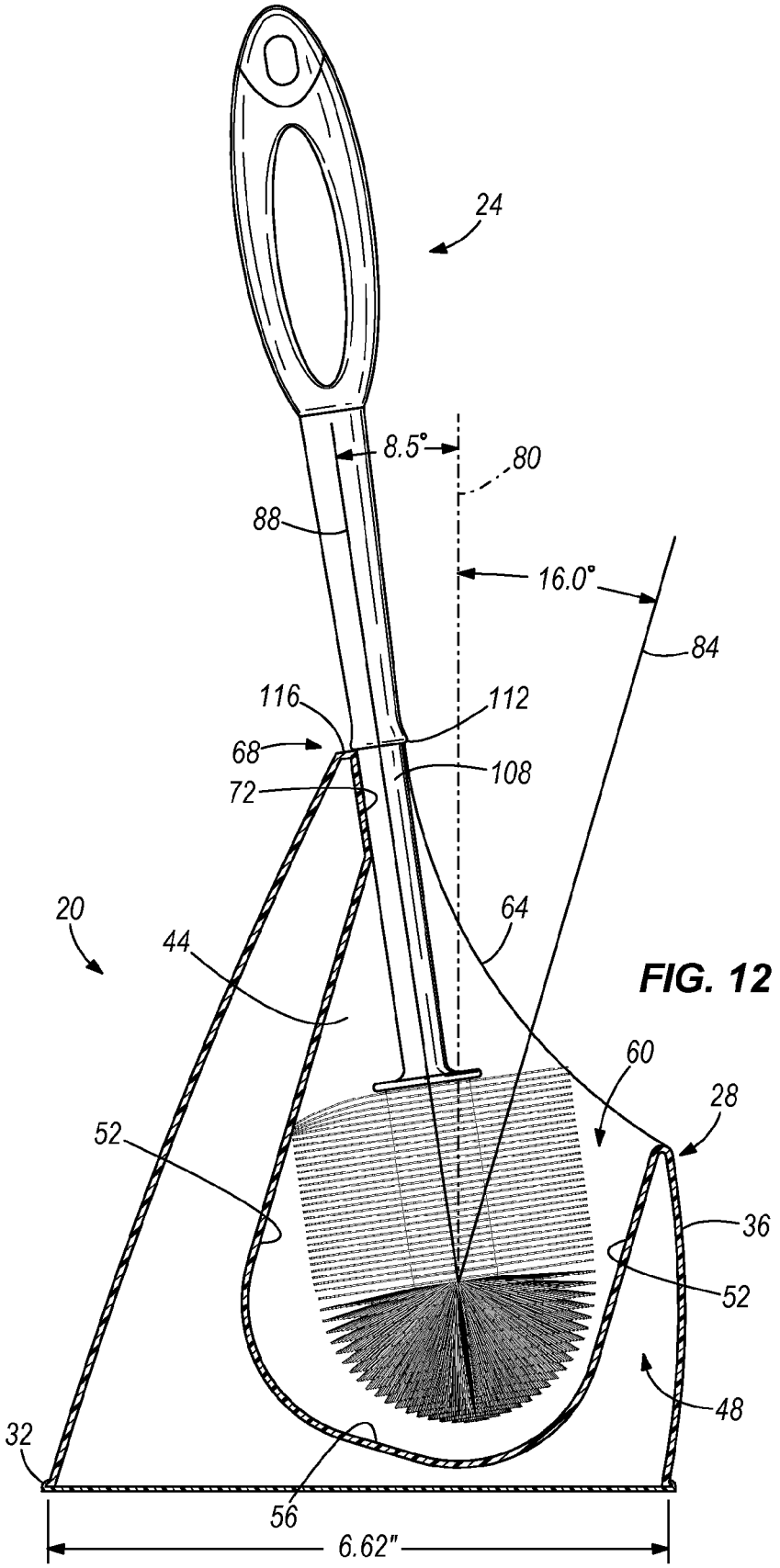
FIG. 12 is a cross-sectional view similar to FIG. 10 showing another exemplary toilet brush caddy and an exemplary brush.
Figure 13:
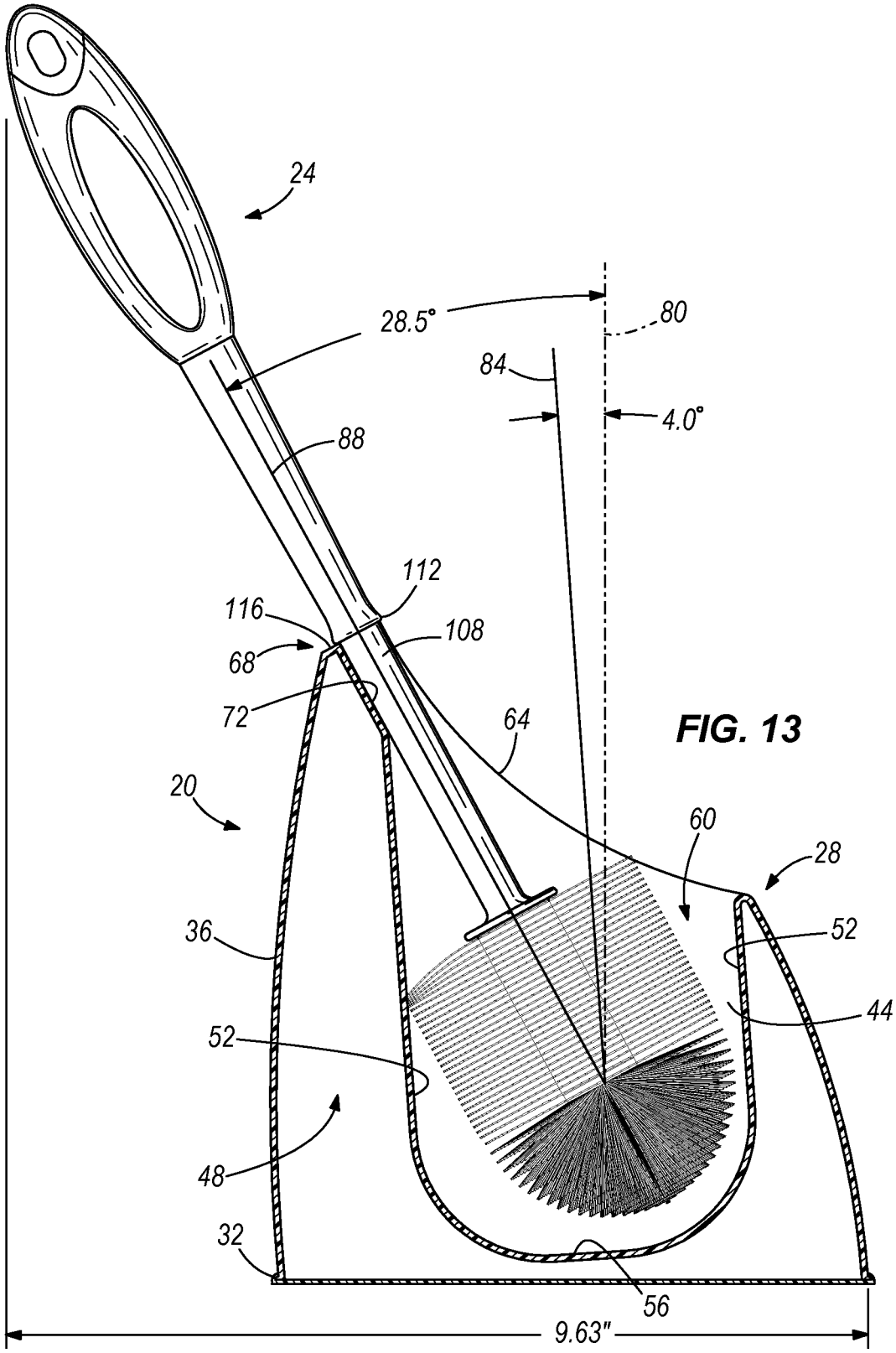
FIG. 13 is a cross-sectional view similar to FIG. 12 showing yet another exemplary toilet brush caddy and an exemplary brush.

With particular reference to FIGS. 10 and 11, the brush receptacle 60 and the brush support 68 will be described further. The brush receptacle 60 is angled relative to a vertical axis 80 of the caddy 20. In other words, the brush receptacle 60 does not open straight upward out of the housing 28. More particularly, a central longitudinal axis 84 of the brush receptacle 60 extends at an angle relative to the vertical axis 80. In some exemplary embodiments, the central longitudinal axis 84 of the brush receptacle extends at an acute angle relative to the vertical axis 80. In the illustrated example, the central longitudinal axis 84 of the brush receptacle 60 extends at about a 6.0° angle relative to the vertical axis 80 of the housing 28. Alternatively, the brush receptacle 60 may be oriented at other angles relative to the housing 28 and, accordingly, the central longitudinal axis 84 of the brush receptacle 60 may extend at other angles relative to the vertical axis 80 and be within the intended scope of the present invention. For example, reference is made to FIG. 12 showing another exemplary caddy 20 having a brush receptacle 60 with a central longitudinal axis 84 extending at about a 16.0° angle relative to the vertical axis 80 of the housing 28. Also for example, reference is made to FIG. 13 showing yet another exemplary caddy 20 having a brush receptacle 60 with a central longitudinal axis 84 extending at about a 4.0° angle relative to the vertical axis 80 of the housing 28.

Referring again to FIGS. 10 and 11 and the brush support 68, the support wall 72 and the support channel 76 are also angled relative to the vertical axis 80 of the housing 28. In other words, the support channel 76 does not open straight upward out of the housing 28. More particularly, a longitudinal axis 88 of the support channel 76 extends at an angle relative to the vertical axis 80. In some exemplary embodiments, the longitudinal axis 88 of the support channel 76 extends at an acute angle relative to the vertical axis 80. In the illustrated example, the longitudinal axis 88 of the support wall 72 extends at about an 18.5° angle relative to the vertical axis 80. Alternatively, the support channel 76 may be oriented at other angles relative to the housing 28 and, accordingly, the longitudinal axis 88 of the support wall 72 may extend at other angles relative to the vertical axis 80 and be within the intended scope of the present invention. For example, reference is made again to FIG. 12 and another exemplary caddy 20 having a brush support 68 with a longitudinal axis 88 extending at about an 8.5° angle relative to the vertical axis 80 of the housing 28. Also for example, reference is made again to FIG. 13 and the illustrated exemplary caddy 20 having a brush support 68 with a longitudinal axis 88 extending at about a 28.5° angle relative to the vertical axis 80 of the housing 28. In the examples illustrated in FIGS. 10 and 12, the central longitudinal axis 84 of the brush receptacle 60 and the longitudinal axis 88 of the support wall 72 extend on opposite sides of the vertical axis 80. In the example illustrated in FIG. 11, the central longitudinal axis 84 of the brush receptacle 60 and the longitudinal axis 88 of the brush support 68 extend on the same side of the vertical axis 80. Angling the brush receptacle 60 and the support channel 76 in the manners described above allow the housing 28 to be easily molded as a unitary one-piece construction, which removes manufacturing time and cost.

Referring now to FIGS. 5, 10, and 11, the manner in which a toilet brush 24 is supported by the caddy 20 will be described. The illustrated exemplary toilet brush 24 includes an elongated handle 92, a cleaning head 96 comprising a plurality of bristles 100 at a first end of the handle 92, and a hand grip 104 at a second end of the handle 92 opposite the cleaning head 96. The handle 92 of this exemplary toilet brush 24 has a generally circular periphery and the support channel 76 of the brush support 68 has a complementary semi-circular shape to accommodate the handle 92 of the toilet brush 24. Alternatively, the handle 92 of the toilet brush 24 can have other shapes such as, for example, oval, polygonal, etc., and similarly the support channel 76 can have other complementary shapes to accommodate these other shapes of the handle 92. The handle 92 includes a first portion 108 have a first size (first diameter in the illustrated example) and a second portion 112 having a second size (second diameter in the illustrated example) larger than the first size, which forms a shoulder where the first portion 108 and second portion 112 meet. In the illustrated example, both the first and second portions 108, 112 are unitarily formed as one-piece with the handle 92.

Alternatively, the second portion 112 may be a separate component supported, connected, adhered, bonded, or otherwise secured to the handle 92 (see FIGS. 15-17, described in greater detail below). The first portion 108 of the handle 92 is positioned in the support channel 76 and the shoulder formed between the first portion 108 and the second portion 112 of the handle 92 engages a top end 116 of the support wall 72. The first portion 108 of the handle 92 is sized slightly smaller than the size of the support channel 76 to ensure that the first portion 108 of the handle 92 will easily fit within the support channel 76. The second portion 112 of the handle 92 is sized slightly larger than the size of the support channel 76 to ensure that the second portion 112 is too large to fit within the support channel 76 and that the shoulder will rest upon the top end 116 of the support channel 76. In the illustrated example, the first portion 108 of the handle 92 has a diameter of about 0.49 inches, which is slightly less than the 0.5 inch diameter of the support channel 76, and the second portion 112 has a diameter slightly greater than 0.5 inches such as, for example, 0.51 inches. The engagement between the shoulder formed between the first portion 108 and the second portion 112 of the handle 92 and the top end 116 of the support channel 76 inhibits the toilet brush 24 from sliding further downward. In this supported position, a top portion of the handle 92 and the hand grip 104 are positioned above the caddy 20 to facilitate gripping of the toilet brush 24 for use and the cleaning head 96 is positioned in the brush receptacle 60 (see FIG. 5). The cleaning head 96 is substantially surrounded on its sides by the side wall 52 and on its bottom by the bottom wall 56. The cleaning head 96 is only exposed from the top due to the open top end 64 of the brush receptacle 60. Also, the cleaning head 96 is supported in such a manner that the bristles 100 of the cleaning head 96 solely engage a front portion of the side wall 52 and are spaced apart from the left, right, and rear portions of the side wall 52 and the bottom wall 56. With few bristles 100 engaging the side wall 52, the bristles 100 are able to dry much quicker than when a large quantity of the bristles 100 engage a surface or when the bristles 100 are submerged in water accumulated on the bottom wall 56 of the brush receptacle 60.

Figure 14:
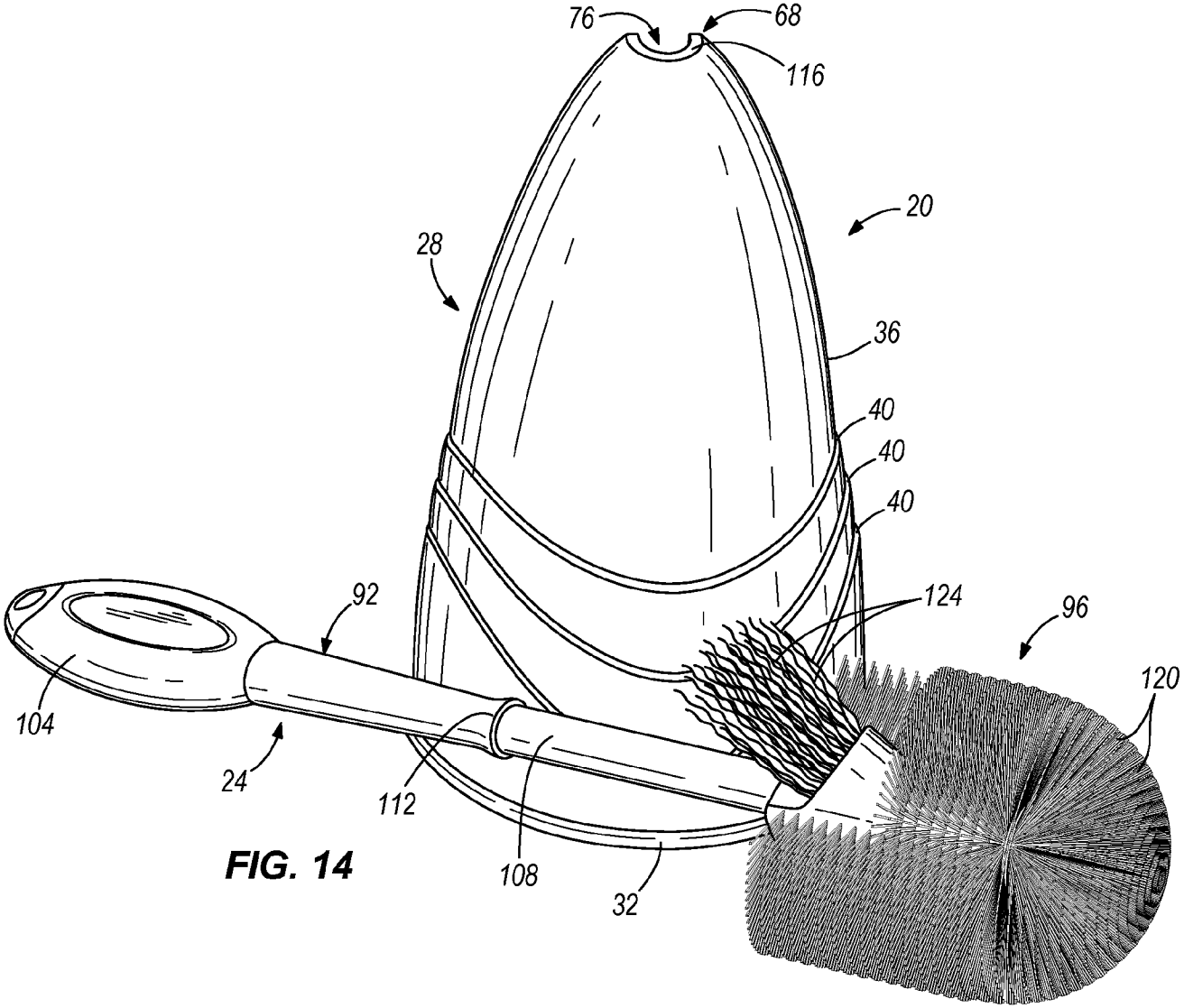
FIG. 14 is a top front perspective of the toilet brush caddy shown in FIG. 1 and another exemplary toilet brush.

Referring to FIG. 14, another exemplary toilet brush 24 is illustrated. This toilet brush 24 includes a similar handle 92 and hand grip 104 to the toilet brush 24 illustrated in FIGS. 1-5, but includes a different cleaning head 96. The cleaning head 96 of this alternative exemplary toilet brush 24 includes a first type of bristles 120 comprising a majority of the cleaning head 96 and a second type of bristles 124 comprising a small portion of the cleaning head 96. The second type of bristles 124 extend upward generally along the handle 92 toward the hand grip 104 and are more coarse or rigid than the first type of bristles 120. The second type of bristles 124 may be used to remove difficult stains and/or to scrub under the rim of a toilet bowl. As indicated above, the caddy 20 is capable of supporting a wide variety of toilet brushes and these two illustrated toilet brushes are only two exemplary toilet brushes of the many toilet brushes supportable by the caddy 20.

Figure 15:
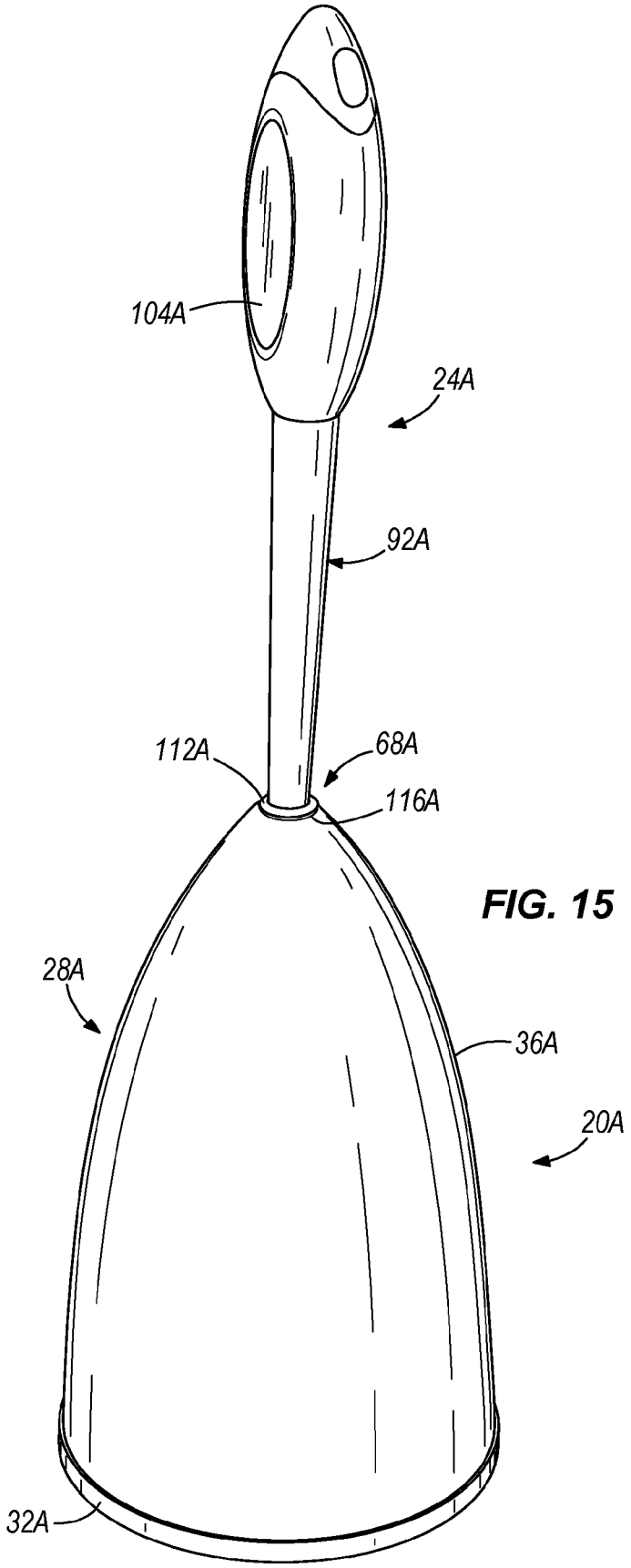
FIG. 15 is a top front perspective of another exemplary toilet brush caddy supporting another exemplary toilet brush.
Figure 16:
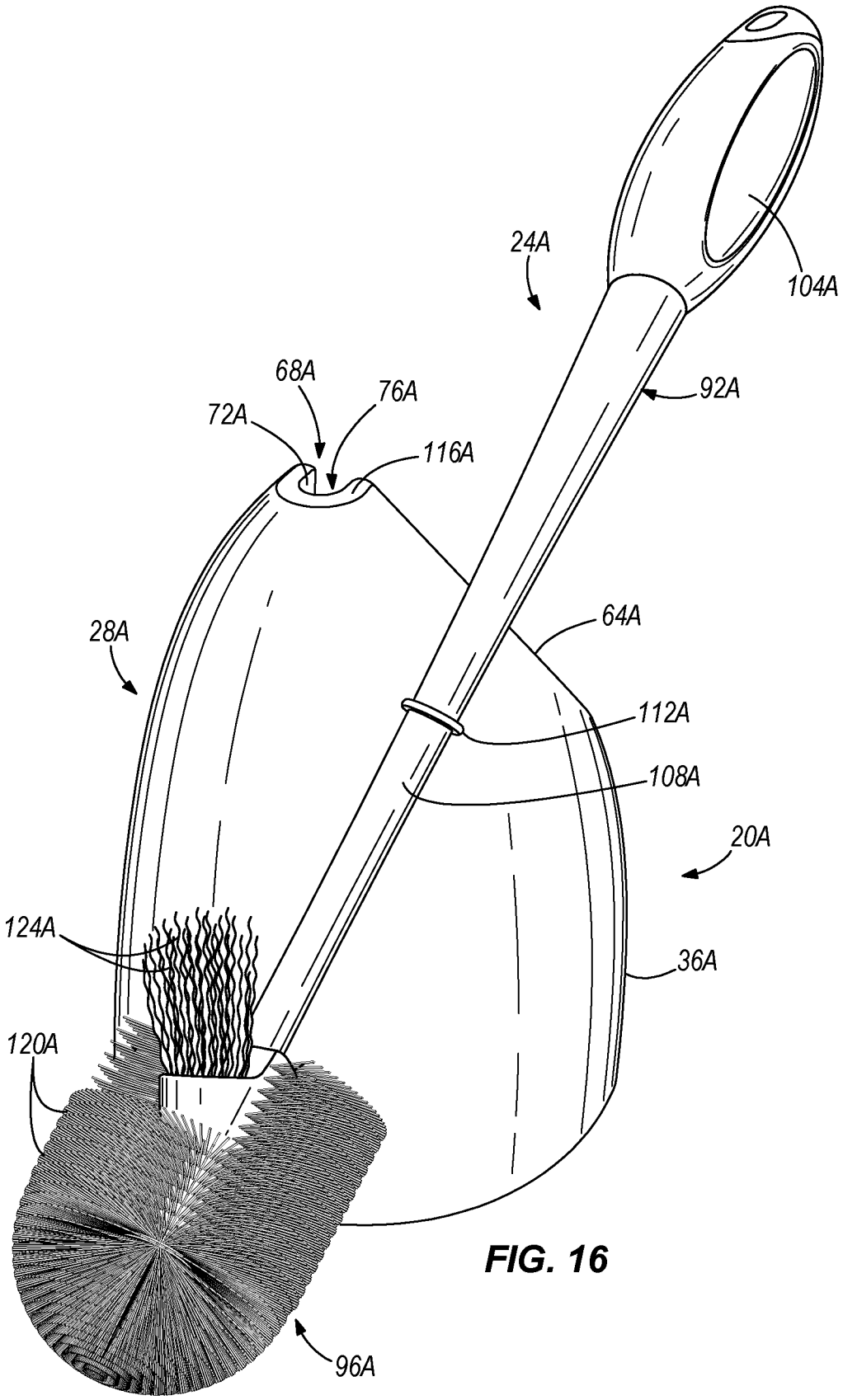
FIG. 16 is a top front perspective view of the toilet brush caddy and toilet brush shown in FIG. 15.
Figure 17:
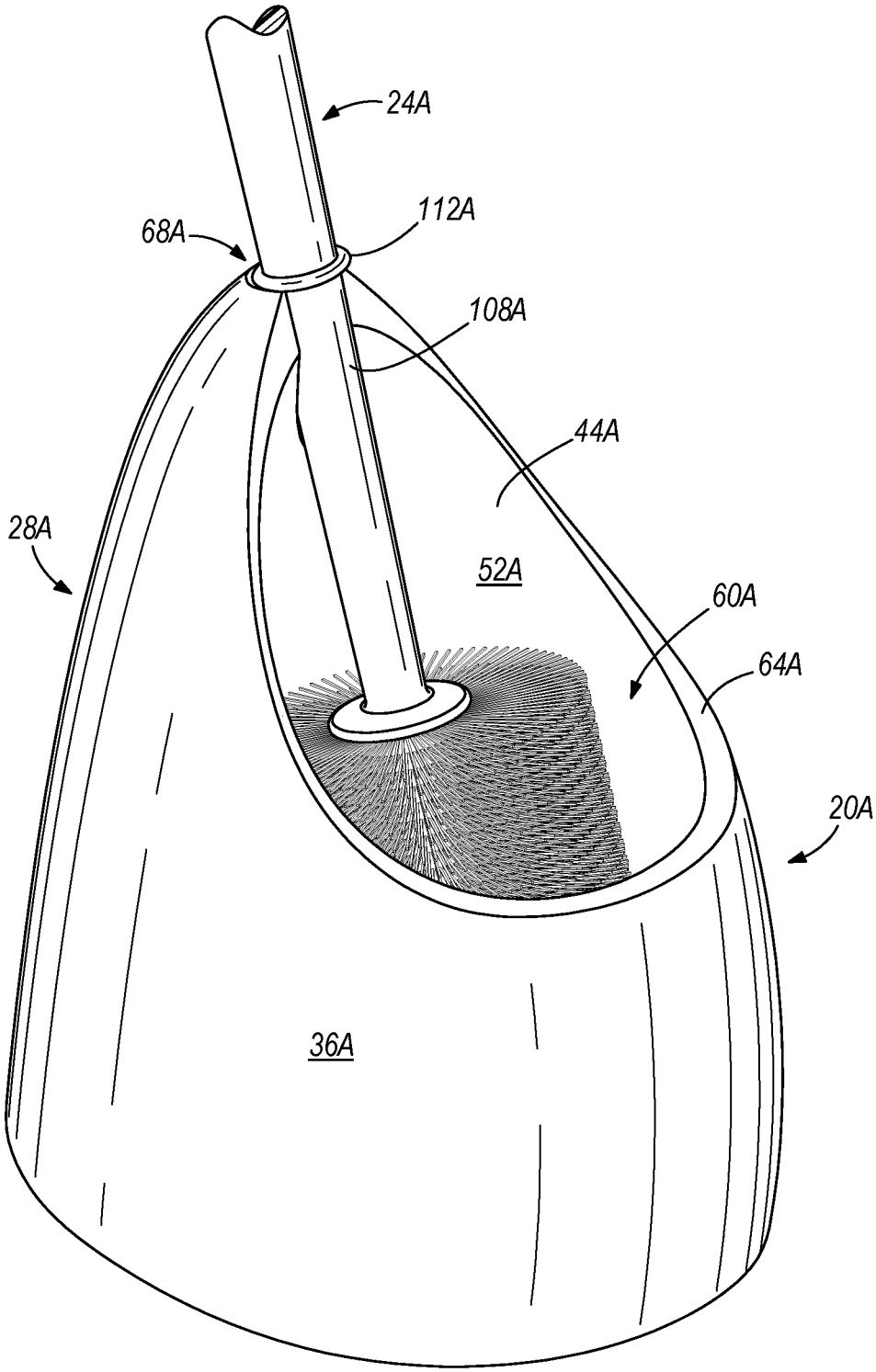
FIG. 17 is a top rear perspective of the toilet brush caddy supporting the toilet brush shown in FIG. 15.

Referring to FIGS. 15-17, another exemplary toilet brush caddy 20A and another exemplary toilet brush 24A are illustrated. Common elements between the caddy 20A and toilet brush 24A of FIGS. 15-17 and the exemplary caddy 20 and toilet brushes 24 of FIGS. 1-11 and 14 are identified by the same reference numbers and an "A". This exemplary caddy 20A is similar in many ways to the exemplary caddy 20 illustrated in FIGS. 1-11 and 14. At least one of the differences between the caddy 20A illustrated in FIGS. 15-17 and the caddy 20 illustrated in FIGS. 1-11 and 14 is that the caddy 20A illustrated in FIGS. 15-17 does not include any steps on the exterior wall 36A. As indicated above, the exterior wall of the caddy can have a variety of different aesthetic features and the exterior wall 36A of this exemplary caddy 20A happens to have a smooth surface without steps. The exemplary toilet brush 24A is similar in many ways to the exemplary toilet brush 24 illustrated in FIGS. 1-5 and the toilet brush 24 illustrated in FIG. 14. At least one of the differences between the toilet brush 24A illustrated in FIGS. 15-17 and the toilet brushes 24 illustrated in FIGS. 1-5 and 14 is that the toilet brush 24A illustrated in FIGS. 15-17 includes an elongated handle 92A having a second portion 112A formed separately from the remainder of the handle 92A and secured to the handle 92A. In this illustrated example, the second portion 112A is an O-ring surrounding the handle 92A, movable along the handle 92A, and frictionally securable in a variety of positions along the handle 92A. In some examples, the handle 92A may include one or more annular slots (not shown) extending around the periphery of the handle 92A in which the O-ring 112A may be positioned to assist with securing the O-ring 112A in place. The movability of the second portion 112A allows a user to select the amount of the handle 92A that extends above the top of the caddy 20A and allows a user to select the positioning of the cleaning head 96A in the brush receptacle 60A. Similarly to the toilet brushes 24 of FIGS. 1-5 and 14, the first portion 108A of the handle 92A is sized slightly smaller than the size of the support channel 76A and the second portion 112A or O-ring is sized slightly larger than the size of the support channel 76A such that the second portion 112A will rest on top end 116A. The cleaning head 96A of the toilet brush 24A illustrated in FIGS. 15-17 is similar to the cleaning head 96 of the toilet brush 24 illustrated in FIG. 14.

Figure 18:
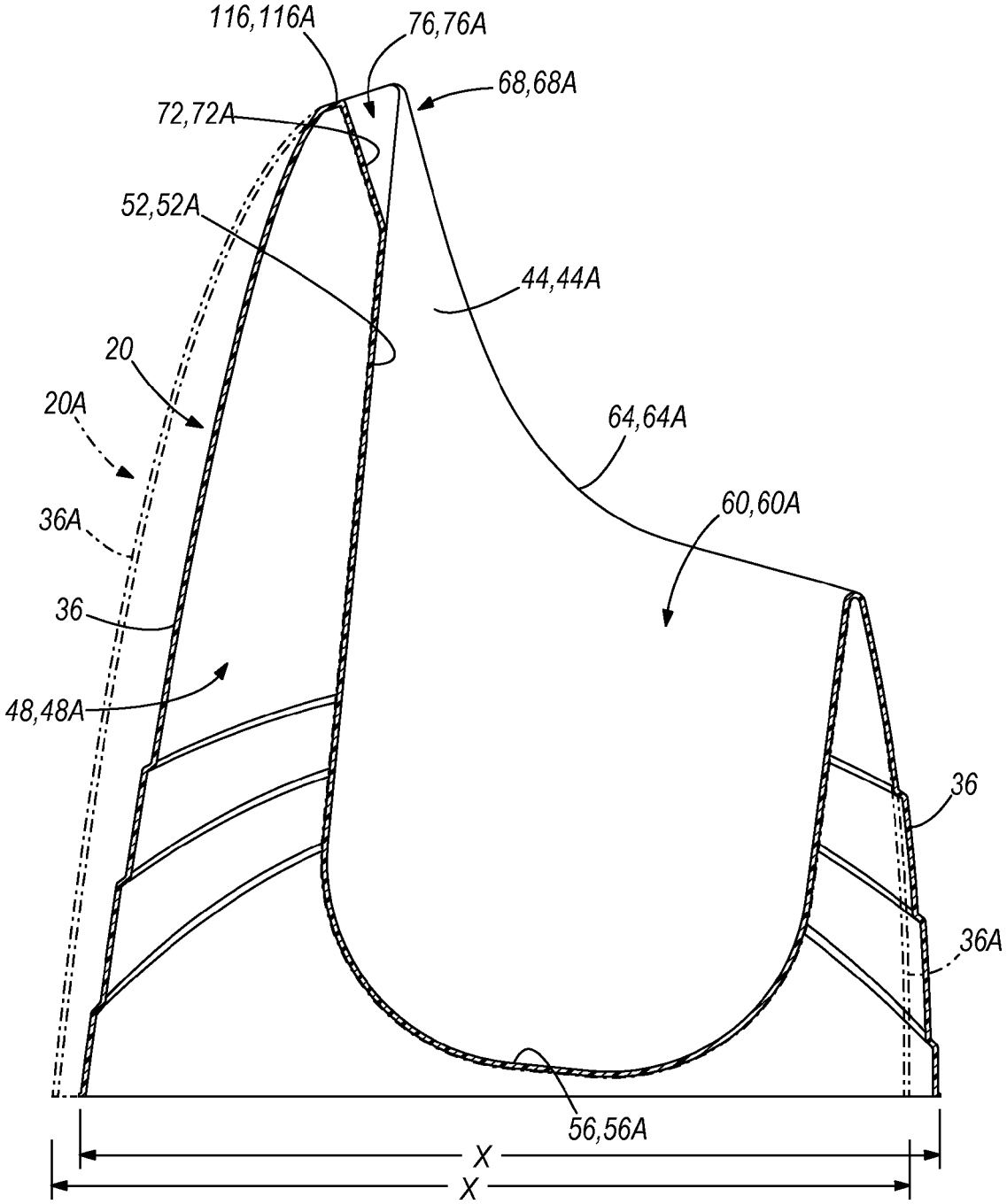
FIG. 18 is an overlay image of a cross-sectional view of the exemplary toilet brush caddy shown in FIG. 1 and a cross-sectional view of the exemplary toilet brush caddy shown in FIG. 15.

Referring now to FIG. 18, cross-sectional views of the caddies 20, 20A illustrated in FIGS. 1-11 and FIGS. 15-17 are overlaid upon each other. In these exemplary caddies 20, 20A, their respective housings 28, 28A are similar except the right portion of the side wall 52 of the brush receptacle 60 is spaced further from the right portion of the exterior wall 36 of the caddy 20 than the right portion of the side wall 52A of the brush receptacle 60A is spaced from the right portion of the exterior wall 36A of the caddy 20A. Likewise, as shown, the left portion of the side wall 52 of the brush receptacle 60 is closer to the left portion of the exterior wall 36 of the caddy 20 than the left portion of the side wall 52A of the brush receptacle 60A of the caddy 20A. Even with this alternative orientation of the brush receptacles 60, 60A relative to the housings 28, 28A of the caddies 20, 20A, the caddies 20, 20A may still have the same depth X. In some examples, the similar depth among the caddies 20, 20A may be about 6.74 inches.

Figure 19:
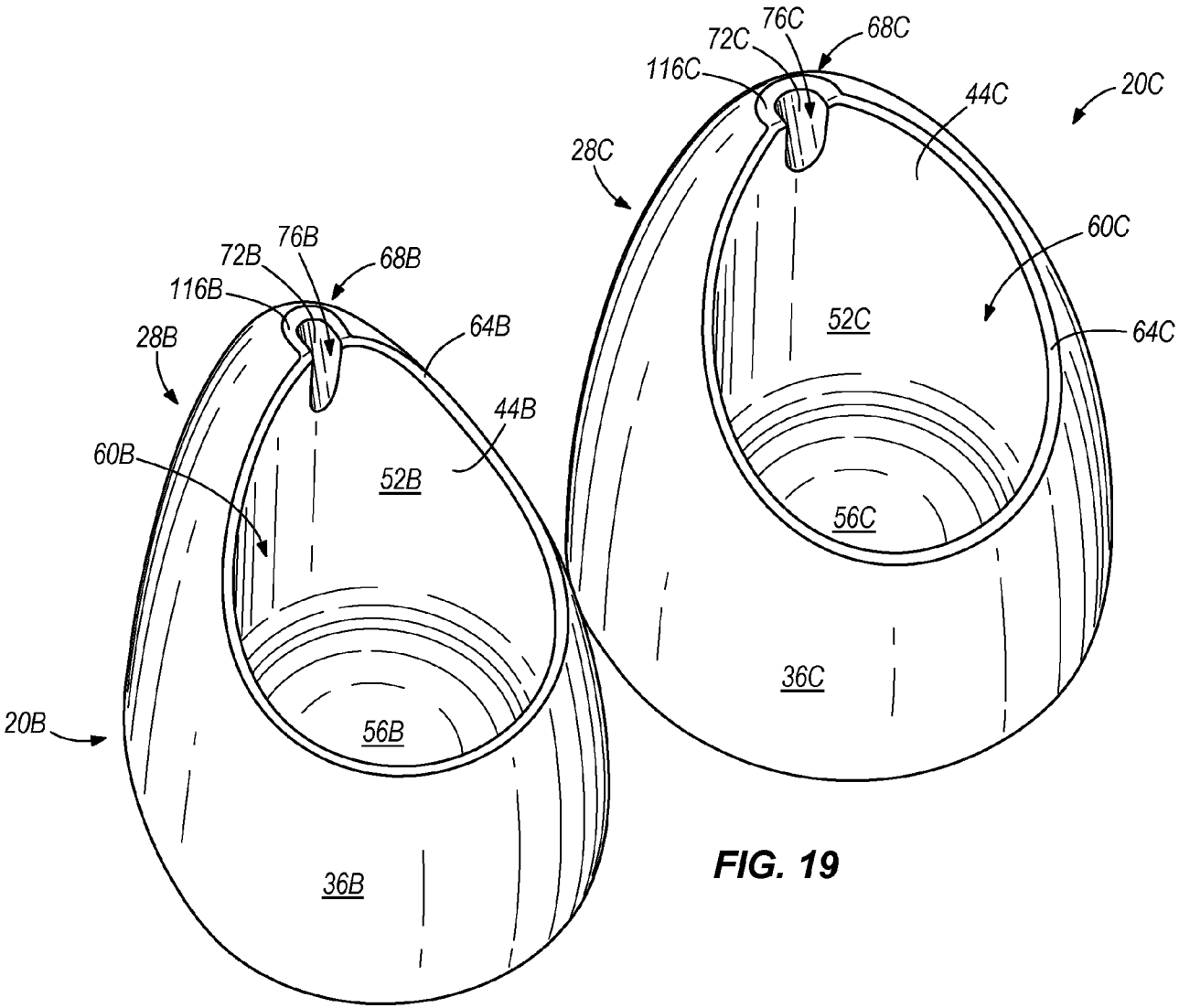
FIG. 19 is a top rear perspective view of a pair of alternative exemplary toilet brush caddies.

With reference to FIG. 19, a pair of alternative toilet brush caddies 20B, 20C are illustrated side by side. Common elements between the caddies 20B, 20C of FIG. 19 and the caddies 20, 20A of FIGS. 1-18 are identified by the same reference numbers and a "B" and a "C", respectively. As indicated above, the toilet brush caddy of the present invention is capable of having various configurations and sizes. FIG. 19 illustrates two different sized caddies 20B, 20C. The caddy 20B is proportionally smaller than the caddy 20C. For example, the support channel 76B of the caddy 20B is smaller than the support channel 76C of caddy 20C, thereby facilitating the caddy 20C to support a toilet brush having a larger sized handle. Also, for example, the brush receptacle 60B of the caddy 20B is smaller than the brush receptacle 60C of the caddy 20C, thereby facilitating the caddy 20C to support a toilet brush having a larger cleaning head. Further, for example, since the brush receptacle 60B for the caddy 20B is smaller, the width of the bottom of the housing 28B may be smaller, thereby providing the caddy 20B with a smaller housing perimeter than the caddy 20C. Other differences are possible between the various types of caddies and are intended to be within the scope of the present invention.

Both caddies 20B, 20C of FIG. 19 are capable of supporting a toilet brush in the same manner as the caddies 20, 20A of FIGS. 1-18 and can be easily molded as a unitary one-piece construction, which reduces manufacturing time and cost. That is, the caddies 20B, 20C are capable of supporting a toilet brush such that a portion of a toilet brush handle extends above the caddies 20B, 20C, the cleaning head is positioned in the brush receptacles 60B, 60C, and the bristles 100B, 100C of the cleaning head 96B, 96C only engage a front portion of the side wall 52B, 52C and are spaced apart from the other portions of the side wall 56B, 56C and bottom wall 52B, 52C.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

The invention claimed is:

1. A toilet brush caddy for supporting a toilet brush, the toilet brush caddy comprising:

a one-piece unitary housing including:

a wall defining a brush receptacle adapted for receiving a cleaning head of the toilet brush, wherein the wall includes at least two sides and a bottom and is adapted to extend around at least two sides and a bottom of the cleaning head with the cleaning head positioned in the brush receptacle, and wherein no more than one of the two sides of the inner wall is engageable by the cleaning head with the cleaning head positioned in the brush receptacle, the brush receptacle having a longitudinal axis extending at an angle relative to a vertical axis of the toilet brush caddy, and a brush support configured to engaged a handle of the toilet brush and to support the toilet brush such that the cleaning head is positionable in the brush receptacle.

2. The toilet brush caddy of claim 1, wherein the wall is an inner wall of the housing, and wherein the housing further includes an exterior wall spaced outward of the inner wall.

3. The toilet brush caddy of claim 2, wherein the inner wall includes four sides and a bottom and is adapted to extend around four sides and a bottom of the cleaning head with the cleaning head positioned in the brush receptacle.

4. The toilet brush caddy of claim 3, wherein no more than one of the four sides of the inner wall is engageable by the cleaning head with the cleaning head positioned in the brush receptacle.

5. The toilet brush caddy of claim 1, wherein the longitudinal axis of the brush receptacle extends at an acute angle relative to the vertical axis of the toilet brush caddy.

6. The toilet brush caddy of claim 5, wherein the acute angle is between about four degrees and about sixteen degrees.

7. The toilet brush caddy of claim 1, further comprising a rim formed separately from and securable to the housing.

8. A toilet brush caddy for supporting a toilet brush, the toilet brush caddy comprising:

a one-piece unitary housing defining a brush receptacle adapted for receiving a cleaning head of the toilet brush, the housing including a brush support adapted to be engaged by and support the toilet brush such that the cleaning head is positionable in the brush receptacle, the brush support including a longitudinal axis extending at an angle relative to a vertical axis of the toilet brush caddy.

9. The toilet brush caddy of claim 8, wherein the longitudinal axis of the brush support extends at an acute angle relative to the vertical axis of the toilet brush caddy.

10. The toilet brush caddy of claim 9, wherein the acute angle is between about eight degrees and about twenty-nine degrees.

11. The toilet brush caddy of claim 9, wherein the brush receptacle includes a longitudinal axis extending at an acute angle relative to the vertical axis of the toilet brush caddy.

12. The toilet brush caddy of claim 11, wherein the longitudinal axis of the brush receptacle extends relative to the vertical axis of the toilet brush caddy between an angle of about four degrees and about sixteen degrees, and wherein the longitudinal axis of the brush support extends relative to the vertical axis of the toilet brush caddy between an angle of about eight degrees and about twenty-nine degrees.

13. The toilet brush caddy of claim 11, wherein the longitudinal axis of the brush receptacle extends to a first side of the vertical axis of the toilet brush caddy and the longitudinal axis of the brush support extends to a second side of the vertical axis of the toilet brush caddy opposite the first side.

14. The toilet brush caddy of claim 11, wherein the longitudinal axes of the brush receptacle and the brush support extend to a same side of the vertical axis of the toilet brush caddy.

15. The toilet brush caddy of claim 8, further comprising a rim formed separately from and securable to the housing.

16. A toilet brush caddy for supporting a toilet brush, the toilet brush caddy comprising:

a one-piece unitary housing including an exterior wall, an inner wall spaced inward from the exterior wall and defining a brush receptacle adapted for receiving a cleaning head of the toilet brush, the brush receptacle having a longitudinal axis extending at an angle relative to a vertical axis of the toilet brush caddy, and a brush support adapted to be engaged by and support the toilet brush such that the cleaning head is positionable in the brush receptacle, the brush support having a longitudinal axis extending at an angle relative to the vertical axis of the toilet brush caddy, wherein the inner wall includes at least two sides and is adapted to extend around at least two sides of the cleaning head with the cleaning head positioned in the brush receptacle, and the cleaning head contacts no more than one of the at least two sides of the inner wall with the cleaning head positioned in the brush receptacle.

17. The toilet brush caddy of claim 16, wherein the inner wall includes a bottom that extends around a bottom of the cleaning head with the cleaning head positioned in the brush receptacle, and the cleaning head does not contact the bottom of the inner wall with the cleaning head positioned in the brush receptacle.

18. The toilet brush caddy of claim 16, wherein the inner wall includes four sides and a bottom and is adapted to extend around four sides and a bottom of the cleaning head with the cleaning head positioned in the brush receptacle, and the cleaning head contacts no more than one of the four sides of the inner wall with the cleaning head positioned in the brush receptacle.

19. The toilet brush caddy of claim 16, wherein the longitudinal axes of the brush receptacle and the brush support extend at acute angles relative to the vertical axis of the toilet brush caddy.

20. The toilet brush caddy of claim 16, wherein the longitudinal axis of the brush receptacle extends relative to the vertical axis of the toilet brush caddy between an angle of about four degrees and about sixteen degrees, and the longitudinal axis of the brush support extends relative to the vertical axis of the toilet brush caddy between an angle of about eight degrees and about twenty-nine degrees.

21. The toilet brush caddy of claim 16, wherein the longitudinal axis of the brush receptacle extends to a first side of the vertical axis of the toilet brush caddy and the longitudinal axis of the brush support extends to a second side of the vertical axis of the toilet brush caddy.

22. The toilet brush caddy of claim 16, wherein the longitudinal axes of the brush receptacle and the brush support extend to a same side of the vertical axis of the toilet brush caddy.

23. The toilet brush caddy of claim 16, further comprising a rim formed separately from and securable to the housing.

* * * * *